US006666355B2

(12) United States Patent
Padar

(10) Patent No.: US 6,666,355 B2
(45) Date of Patent: Dec. 23, 2003

(54) FLUID DISPENSING DEVICE

(76) Inventor: Steven Padar, Theresenstrasse 17, 65779 Kelkheim (DE)

( * ) Notice: Subject to any disclaimer, the term of this patent is extended or adjusted under 35 U.S.C. 154(b) by 0 days.

(21) Appl. No.: 10/403,733

(22) Filed: Mar. 31, 2003

(65) Prior Publication Data

US 2003/0183655 A1 Oct. 2, 2003

Related U.S. Application Data

(63) Continuation of application No. PCT/EP01/11534, filed on Oct. 6, 2001.

(30) Foreign Application Priority Data

Oct. 10, 2000 (DE) ..... 100 49 898

(51) Int. Cl.[7] ..... B65D 88/54

(52) U.S. Cl. ..... 222/152; 222/105; 222/321.9; 222/481; 141/65

(58) Field of Search ..... 222/95, 105, 152, 222/320, 321.1, 321.6, 321.7, 321.9, 372, 373, 378, 380, 383.1, 385, 478, 481; 141/7, 8, 23, 26, 65, 85; 53/403, 408, 432, 433, 434, 510, 511, 512, 79

(56) References Cited

U.S. PATENT DOCUMENTS 4,532,967 A * 8/1985 Graf ..... 141/3
5,405,038 A * 4/1995 Chuang ..... 220/231
5,692,649 A 12/1997 Schwab ..... 222/321.3
5,769,274 A * 6/1998 Behar ..... 222/95
6,053,368 A * 4/2000 Geimer ..... 222/189.09

FOREIGN PATENT DOCUMENTS

EP 0 739 247 B1 1/1995 ..... B05B/11/00

* cited by examiner

*Primary Examiner*—Gene Mancene
*Assistant Examiner*—Patrick Buechner
(74) *Attorney, Agent, or Firm*—Heslin Rothenberg Farley & Mesiti P.C.

(57) ABSTRACT

A device for dispensing fluids from a sealed off-storage container includes a housing placed on the container that receives a pressure cylinder for insertion in the container. The cylinder has a pressure chamber defined at the upper end by a piston guided in the cylinder and at the lower end by a valve. The valve acts upon the container and is closed when there is an excess pressure and opens when there is a negative pressure in the chamber. The piston has a pump channel linked with the chamber, and the cylinder has openings upstream of the chamber for drawing off residual air present in the container. A passage between an outer wall of the piston and an inner wall of the cylinder upstream of the openings is closed by a sealing washer. Residual air is drawn off via the openings and the passage, whereby the sealing washer loses its sealing effect on the piston.

12 Claims, 2 Drawing Sheets

FLUID DISPENSING DEVICE

CROSS REFERENCE TO RELATED APPLICATIONS

This application is a continuation of international application PCT/EP01/11534 filed Oct. 6, 2001 and published as WO 02/30577 A1 in German on Apr. 18, 2002, and claims priority of German application No. 100 49 898.1 filed Oct. 10, 2000, the contents of which are incorporated herein by reference in their entirety.

FIELD OF THE INVENTION

The invention relates to a device for dispensing fluids from a sealed storage container.

BACKGROUND ART

Conventional devices for dispensing pharmaceuticals are known. Metering pumps of this type permit the delivery of a defined quantity of a fluid from a storage container.

EP-O 739 247 B1 describes a metering pump without equalization of air which is intended for the spraying of liquids whose working life is reduced on contact with atmospheric oxygen. The known metering pump has a pressure cylinder which protrudes into the fluid container and in which a piston having an axial pump channel is guided in a sealing manner. A pressure chamber is formed in the pressure cylinder, said pressure chamber being bounded by the piston and by a ball valve, which acts relative to the fluid container and closes when there is positive pressure and opens when there is negative pressure, and being connected to the axial pump channel. The piston is kept in the upper rest position by spring force. When the piston is pressed downward, the pressure in the pressure chamber increases, the valve to the fluid container is closed and the liquid present in the pressure chamber escapes under pressure to the outside through the axial pump channel. When the piston is released, a negative pressure arises in the pressure chamber, with the result that the valve to the fluid container opens and liquid is drawn into the pressure chamber. Since the metering pump operates without equalization of air, the fluid container contains an inner bag which is sealed with respect to the atmosphere and collapses when the fluid container is emptied.

During filling of the metering pumps not having equalization of air, residual air remains in the inner bag. During storage the fluid is therefore constantly in touch with atmospheric oxygen, which leads to a reduction in the storage life or the freedom of the liquid from germs. However, emptying of the fluid container in a germ-free atmosphere or under protective gas is very complex and expensive. Moreover, complete emptying of the bag is only possible when no residual air remains in the bag after it has been filled.

EP-O 739 247 B1 therefore proposes drawing off the residual air via the axial pump channel. In order to provide a connection to the inner bag, openings are provided in the pressure cylinder. Furthermore, the piston is guided in a sealing manner by a circumferential sealing lip only over part of the pressure cylinder. In a certain position of the piston, the residual air from the bag can therefore be drawn off via the openings in the pressure cylinder, the gap between the inner wall of the pressure cylinder and the outer wall of the piston into the pressure chamber and from the pressure chamber via the axial pump channel. In order to prevent liquid from passing into the pressure chamber when a negative pressure is applied, the valve acting relative to the bag has to be closed. This takes place by means of a tappet which is introduced into the piston when the residual air is drawn off.

The known method has been tried and tested in practice. However, it is disadvantageous that, in order to draw off the residual air, the ball valve acting relative to the fluid container has to be closed by means of the tappet. There is the risk here of the tappet jamming the ball of the ball valve. This can only be prevented by very great dimensional accuracy which leads to a higher outlay on production. Moreover, the creation of the connection between the bag and pressure chamber is also associated with an increased outlay on production. Otherwise, it is disadvantageous that the protective cap has to be removed from the metering pump in order to be able to connect a suction pump to the pump channel.

BRIEF SUMMARY OF THE INVENTION

The invention is therefore based on the object of providing a device for dispensing fluids from a sealed storage container, in which the removal of residual air is possible in a particularly simple manner.

This object is achieved by the features of patent claim 1.

The residual air in the storage container is not drawn off via the axial pump channel, but rather via a passage which is formed between the outer wall of the piston and the inner wall of the pressure cylinder above the opening in the pressure cylinder. In order to close the passage, means are provided which are created in such a manner that residual air can be drawn off from the storage container via the passage when a negative pressure is applied, but otherwise the passage is closed. Since the residual air is not drawn off via the axial pump channel, the protective cap does not need to be removed from the dispensing device.

In a preferred embodiment, the passage between the piston and pressure cylinder leads into a space which is to be charged with negative pressure and is formed in the housing body. In order to draw off the residual air, a vacuum pump for producing the negative pressure is connected to the housing body.

The means for closing the passage are preferably designed as a sealing washer with a circular recess in which the piston is guided in a sealing manner. A sealing washer of this type, which preferably consists of polyethylene, can be inserted into the housing body without a relatively great outlay in terms of manufacturing.

The passage for drawing off the residual air between the piston and pressure cylinder is preferably a gap, i.e. the piston is not guided in a sealing manner in this region of the pressure cylinder. However, it is also possible, instead of a gap, to provide grooves or the like running longitudinally in the inner wall of the pressure cylinder and/or the outer wall of the piston.

One or more openings can be provided in the pressure cylinder in order to draw off the air. The openings in the pressure cylinder are preferably slots distributed around the circumference.

In a further preferred embodiment, the housing body has two housing parts with a respective cylindrical section which can be displaced relative to each other in order to actuate the piston. These two housing parts preferably enclose the space to be charged with negative pressure and are preferably sealed relative to each other when they are compressed, with the result that the piston is advanced into the pressure chamber. However, the cylindrical sections of the two housing parts may also be sealed relative to each other with an annular seal or the like in such a manner that a negative pressure can also build up in the space enclosed by the two parts when the piston is not in the advanced position.

The piston is sealed below the opening in the rotary cylinder preferably only by a circumferential sealing lip at the lower end of the piston, the pressure cylinder being extended, for venting purposes, in a region at the lower end of the pressure chamber in such a manner that the sealing action of the sealing lip is lost in this region.

In order to be able to draw off the residual air via the passage, the two housing parts of the housing body are compressed, with the result that the piston is advanced into the pressure chamber. In this position, the two housing parts are sealed relative to each other, and the sealing lip of the piston is sealed with respect to the pressure cylinder. In this case, the sealing lip bears in a sealing manner against the inner wall of the pressure cylinder below the extension of the latter. Below the extension, the sealing lip can also rest on a step of the pressure cylinder which forms a lower stop for the piston. The effect achieved by sealing the piston with respect to the pressure chamber is that, when the residual air is drawn off, the axial pump channel is closed, with the result that liquid cannot be drawn out of the container.

Since the pump channel is closed by the piston when drawing off the residual air, the valve acting relative to the storage container does not need to be closed by means of a tappet or the like, this increasing the outlay in terms of manufacturing due to the high dimensional accuracy.

The housing body can be fastened to the storage container, in particular a glass or plastic bottle, by means of a clamping or screw fastening.

DESCRIPTION OF THE DRAWINGS

An exemplary embodiment of the invention is explained in greater detail below with reference to the drawings.

DETAILED DESCRIPTION

Figure 2:
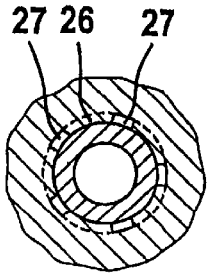
FIG. 2 shows a section along the line II—II from FIG. 1.

The dispensing device is intended for the spraying of a liquid from a storage container 1 with a collapsible bag 1*a* which is inserted into the storage container.

The housing body 2 of the dispensing device comprises a lower housing part 3 and an upper housing part 4 which is placed onto the lower housing part 3. The lower housing part 3 of the housing body is designed as a closure cap which is placed onto the storage container 1 in a snapping-on and sealing manner. The lower housing part 3 receives a pressure cylinder 5 which extends into the storage container 1. A pressure chamber 6 is formed at the lower end of the pressure cylinder 5, said pressure chamber being bounded at the upper end by a piston 7 guided in the pressure cylinder and at the lower end by a ball valve acting relative to the storage container 1.

Figure 1:
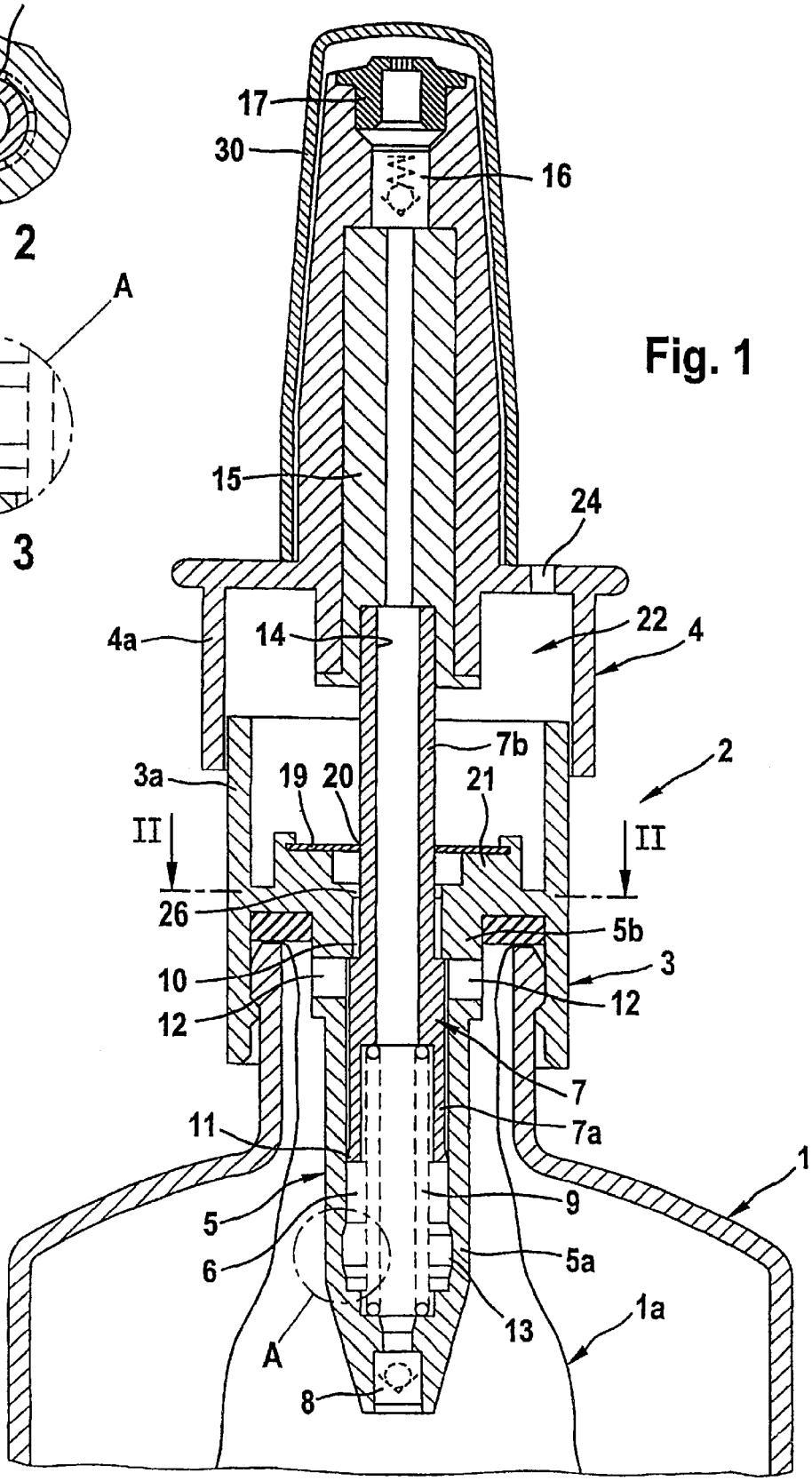
FIG. 1 shows the dispensing device together with the storage container in a cutaway illustration with the piston in the rest position.
Figure 5:
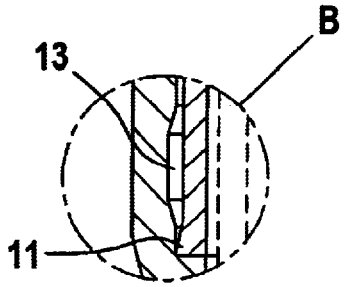
FIG. 5 shows the detail B from FIG. 4 in an enlarged illustration.

The piston 7 has a lower section 7*a* and an upper section 7*b*, with the outside diameter of the lower section being slightly larger than the diameter of the upper section. The pressure cylinder 5 correspondingly has a lower section 5*a* with a larger inside diameter and an upper section 5*b* with a smaller diameter. In the rest position shown in FIG. 1, the lower section 7*a* of the piston 7 is prestressed toward the upper section 5*b* of the pressure cylinder 5 by means of a compression spring 9 inserted into the pressure cylinder 5. The upper section 5*b* of the pressure cylinder 5 has, at its upper edge, an annular projection 26 having a plurality of grooves 27 distributed around the circumference. The inside diameter of the annular projection 26 corresponds to the outside diameter of the piston 7, so that the piston is guided in the projection (FIG. 2). Since the piston 7 otherwise has a smaller diameter than the pressure cylinder 5, a narrow gap remains between the outer wall of the piston and inner wall of the cylinder.

Figure 3:
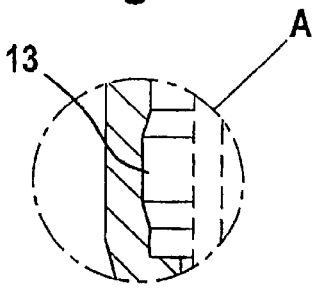
FIG. 3 shows the detail A from FIG. 1 in an enlarged illustration.

The piston 7 is filled with respect to the pressure cylinder 5 solely by a sealing lip 11 which is arranged at the lower end of the piston. In the lower region of the pressure chamber 6, the inside diameter of the pressure cylinder 5 increases slightly in order then to be reduced again. In the region of this extension 13, the sealing action of the lip 11 is lost (FIG. 3).

The gap 10 between the upper section 7*b* of the piston and the upper section 5*b* of the pressure cylinder 5 is closed by a flexible sealing washer 19. The sealing washer 19 consists of polyethylene and has, in the center, a circular recess 20 in which the piston 7 is guided in a sealing manner. The outer edge of the sealing washer 19 is inserted in a sealing manner in the lower housing part 3 of the housing body 2, with the sealing washer resting with its lower side in the region of the outer edge on a peripheral step 21 of the housing body, but in contrast being freely movable in the inner region.

Above the pressure chamber 6, the pressure cylinder 5 is provided with a plurality of slots 12 distributed around the circumference. The piston 7 has an axial pump channel 14 which is connected to a rising tube 15 which is fastened to the upper housing part 4. The upper end of the rising tube 15 is closed by a nonreturn valve 16. For the spraying of the liquid, a spray head 17 is provided above the nonreturn valve. A closure cap 30, which closes the pump channel 14 in a sealing manner, fits on the rising tube 15.

The upper and lower housing part 3, 4 of the housing body 2 each have a cylindrical section 3*a*, 4*a* which can be displaced relative to each other. An opening 24 for drawing off the residual air is provided on the upper housing part 4 next to the rising tube.

The dispensing device operates as follows. It should first of all be assumed that the storage container 1 is filled with liquid but the dispensing device is still free from liquid. When the upper and lower housing parts 3, 4 of the housing body 2 are compressed, the piston 7 is displaced into the pressure space 6, with it being possible for the air present in the pressure space to escape through the axial pump channel 14 and the rising tube 15. In this connection, the positive pressure in the pressure space causes the nonreturn valve 16 to be opened and the ball valve 8 to be closed. When the spring force causes the piston to spring back, a negative pressure is produced in the pressure space, with the result that the ball valve 8 opens and the nonretum valve 16 closes.

The negative pressure causes liquid to be drawn out of the storage container 1 into the pressure chamber. If the piston is subsequently advanced again, the liquid is pressed out of the pressure chamber 6 to the outside via the axial pump channel 14 and the rising tube 15, in which case the nonreturn valve 16 opens and the ball valve 8 closes.

Figure 4:
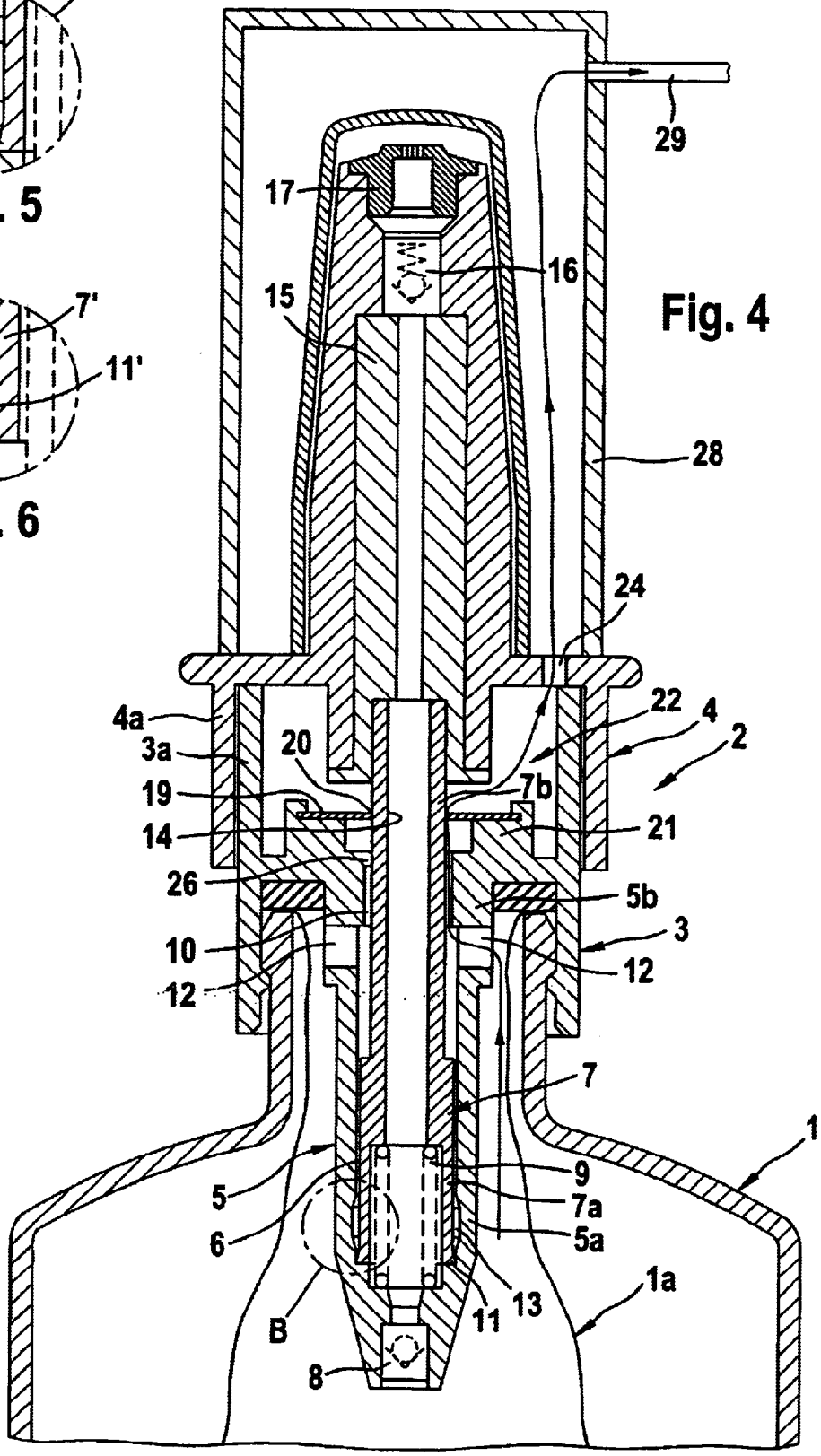
FIG. 4 shows the dispensing device from FIG. 1 together with a suction device for drawing off the residual air, with the piston in the advanced position.

The method for drawing off the residual air in the storage container will be described below. In order to draw off the residual air, a negative pressure is produced in the space 22 enclosed by the upper and lower housing part 3, 4. For this purpose, the two housing parts 3, 4 are compressed, so that the cylindrical section 3*a* of the lower housing part 3 is supported in a sealing manner on the upper housing part 4 (FIG. 4). In this position, the piston 7 is advanced into the pressure cylinder 5, and the sealing lip 11 of the piston 7 is situated below the extension 13, with the result that the pressure chamber 6 is also closed when the ball valve 8 is opened.

The residual air is drawn off by means of a vacuum pump (not illustrated) which has a suction device 28 which is designed in the manner of a cap and to which the pressure hose 29 of the vacuum pump is connected. The suction cap is placed in a sealing manner onto the upper housing part 3 of the housing body 2 of the dispensing device, with the opening 24 of the housing part 3 lying within the suction cap. The closure cap 30 does not need to be removed for this. The vacuum pump is then switched on. As a result of the negative pressure, the sealing washer 19 loses its sealing action relative to the piston 5, so that the residual air flows out of the inner bag 1*a* via the slots 12 in the pressure cylinder 5 and the gap between the upper section 5*b* of the pressure cylinder 5 and the upper section 7*b* of the piston 7 and the grooves 27 at the upper edge of the pressure cylinder into the space 22. The above-described route of the residual air from the inner bag as far as the pressure hose is illustrated in FIG. 4 with the aid of arrows. If all of the residual air has been drawn off, the vacuum pump is switched off and the suction cap is removed again. Since negative pressure no longer prevails in the space 22, the sealing washer 19 again seals the piston with respect to the pressure cylinder.

In principle, it is also possible to draw off the residual air when the piston is not in the advanced position. However, the housing body cannot then be sealed owing to the fact that the upper edge of the lower housing part is supported on the upper housing part. The cylindrical sections 3*a*, 4*a* of the lower and upper housing parts may, however, for this purpose be sealed relative to each other, for example by means of an annular seal which is inserted into an annular groove of the upper housing part 4.

Figure 6:
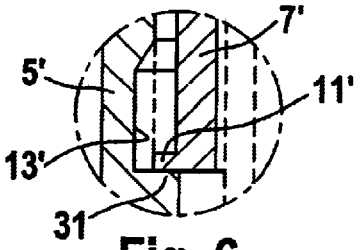
FIG. 6 shows a partial view of the pressure cylinder with the piston in an alternative embodiment in an enlarged illustration.

FIG. 6 shows a partial view of an alternative embodiment of the pressure cylinder 5' with the piston 7' in the region of the extension 13'. In this exemplary embodiment, the piston 7' is supported with its sealing lip 11' on an inwardly projecting step 31 of the pressure cylinder below the extension 13', with the result that the pressure chamber 6 is closed irrespective of the position of the ball valve 8. The step 31 also forms a front stop for the piston which, as a result, can be fastened in a particularly simple manner to the rising tube during installation.

What is claimed is:

1. A device for dispensing fluids from a sealed storage container, having a housing body which can be placed onto the storage container and receives a pressure cylinder which can be inserted into the storage container and in which a pressure chamber is formed, said pressure chamber being bounded at an upper end by a piston guided in the pressure cylinder and at a lower end by a valve which acts relative to the storage container, closing when there is positive pressure in the pressure chamber and opening when there is negative pressure, the piston having a pump channel connected to the pressure chamber, and the pressure cylinder having, above a pressure space, at least one opening for drawing off residual air present in the storage container, wherein a passage for the residual air to be drawn off is formed between an outer wall of the piston and an inner wall of the pressure cylinder above the at least one opening, and means for closing the passage arc provided, the means being created in such a manner that residual air can be drawn off from the storage container through the passage when a negative pressure is applied.

2. The dispensing device as claimed in claim 1, wherein the passage leads into a space which is to be charged with negative pressure and is formed in the housing body.

3. The dispensing device as claimed in claim 1, wherein the means for closing the passage are designed as a sealing washer, in particular of polyethylene, with a circular recess in which the piston is guided in a sealing manner.

4. The dispensing device as claimed in claim 1, wherein the passage is a gap which is provided between the outer wall of the piston and the inner wall of the pressure cylinder.

5. The dispensing device as claimed in claim 1, wherein the at least one opening in the pressure cylinder comprises slots arranged around a circumference.

6. The dispensing device as claimed claim 1, wherein the housing body has a first housing part with a first cylindrical section and a second housing part which is placed with a second cylindrical section onto the first housing part, and in that a rising tube connected to the pump channel of the piston is fastened to the first housing part of the pressure cylinder and to the second housing part, it being possible for the first and second housing parts to be displaced relative to each other for actuation of the piston.

7. The dispensing device as claimed in claim 6, wherein the first and second housing parts are sealed relative to each other, with the space to be charged with negative pressure being surrounded by the two housing parts.

8. The dispensing device as claimed in claim 7, wherein the first and second housing parts are sealed relative to each other when the housing parts are compressed and the piston is advanced into the pressure chamber.

9. The dispensing device as claimed in claim 7, wherein an opening is provided on the second housing part.

10. The dispensing device as claimed in claim 8, wherein the piston is sealed in the pressure cylinder below the at least one opening only by a circumferential sealing lip at a lower end of the piston, the pressure cylinder being extended in a region at the lower end of the pressure chamber in such a manner that the sealing lip does not seal the piston in this region with respect to the pressure cylinder.

11. The dispensing device as claimed in claim 10, wherein the sealing lip of the piston is sealed with respect to the pressure cylinder when the first and second housing parts are compressed and the piston is advanced into the pressure chamber.

12. The dispensing device as claimed in claim 11, wherein the sealing lip of the piston in a position advanced into the pressure chamber lies below an extension at the lower end of the pressure chamber.

* * * * *